United States Patent [19]

Cheng

[11] Patent Number: 4,821,896

[45] Date of Patent: Apr. 18, 1989

[54] NURSING BOTTLE WITH A LINER AND VENT

[76] Inventor: Ping N. Cheng, No. 45, Huo I Road, Keelung City, Taiwan

[21] Appl. No.: 172,456

[22] Filed: Mar. 24, 1988

[51] Int. Cl.[4] ..... A61J 9/00; A61J 9/04

[52] U.S. Cl. ..... 215/11.3; 215/11.5; 220/404

[58] Field of Search ..... 215/11.1–11.6; 220/404, DIG. 27

[56] References Cited

U.S. PATENT DOCUMENTS

| | | | |
|---|---|---|---|
| 2,907,485 | 10/1959 | Lunden | 215/11.1 |
| 3,206,054 | 9/1965 | Militello | 215/11.3 |
| 4,339,046 | 7/1982 | Coen | 215/11.5 |
| 4,723,668 | 2/1988 | Cheng | 215/11.5 |

*Primary Examiner*—Sue A. Weaver

[57] ABSTRACT

A bottle includes male threads formed on an outer bottom surface; a hollow protrusion formed on a base of the bottle protruding inwardly toward an interior of the bottle and having an opening formed on a top of the hollow protrusion; a silicon rubber layer disposed on a bottom of the bottle having an elastic protrusion snugly received in the hollow protrusion and a slit formed on a top of the elastic protrusion; a base casing having female threads formed on its inner surface engageable with the male threads of the bottle and having a vent formed in a central portion of the base casing; and a disposable liner bag having a reinforced wall made of silicon rubber formed on a central location of the bag, having a cut positioned at the center of the reinforced wall. The slit on the elastic protrusion and the cut on the liner bag remains closed in normal (non-suction) condition, thereby preventing the milk or liquids from dripping out. The cut of the liner bag is axially aligned with the opening of the hollow protrusion, the slit of the elastic protrusion of the rubber layer, and the vent of the base casing. Once the bottle is inverted and the nipple is sucked on, the slit and the cut opens to a certain amount to let the air flow into the bottle and the bag. Thus, milk flows out of the nipple continuously during suction.

1 Claim, 3 Drawing Sheets

NURSING BOTTLE WITH A LINER AND VENT

BACKGROUND OF THE INVENTION

This invention relates to a feeding bottle structure, and more particularly relates to such a structure which provides the infant with a convenient way of sucking milk from the feeding bottle and in which a vented bag is applied.

It is known that feeding bottles are provided with a vent assembly which is essentially defined by an elastic insert having a vent slit therein, with the insert being secured at the periphery of an opening through the wall or bottom of the conventional bottle by means of a plug member, as disclosed in British Patent Application No. 2139903 by Suh and British Pat. No. 14739 by Jordan. In both cases, the elastic insert, in its assembled position, is fully exposed to the interior of the bottle and is therefore subject to deformation through contact with the liquid contained therein. Another type of conventional feeding bottle has male threads on the lower bottom surface and a protruding surface on the base thereof, a silicon rubber layer provided with an elastic protrusion which has a slit on the top, and a base casing with female threads for securing the lower bottom surface of the bottle thereto and a minute vent provided in alignment with the elastic protrusion thereon, as described in U.S. patent application Ser. No. 942,776, now U.S. Pat. No. 4,723,668, filed by the same applicant. Moreover, feeding bottles with disposable feeding bags are more convenient and sanitary than the feeding bottles which do not incorporate disposable bags for outdoor use, and obviate the need for cleaning and disinfecting of non-disposable feeding bags.

The present invention has arisen from work in seeking to facilitate feeding the infants.

SUMMARY OF THE INVENTION

A primary objective of this invention is to provide a convenient, easy-to-suck feeding bottle structure which can be readily produced.

Another objective of this invention is to provide a hygienic feeding bottle together with a disposable liner bag which is provided with a vented opening.

Still another objective of this invention is to provide a stable feeding bottle structure which has a lower center of gravity, and therefore does not easily fall down.

Another objective of this invention is to provide an improved feeding bottle structure which has performance characteristics superior to any nursing bottle heretofore available.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
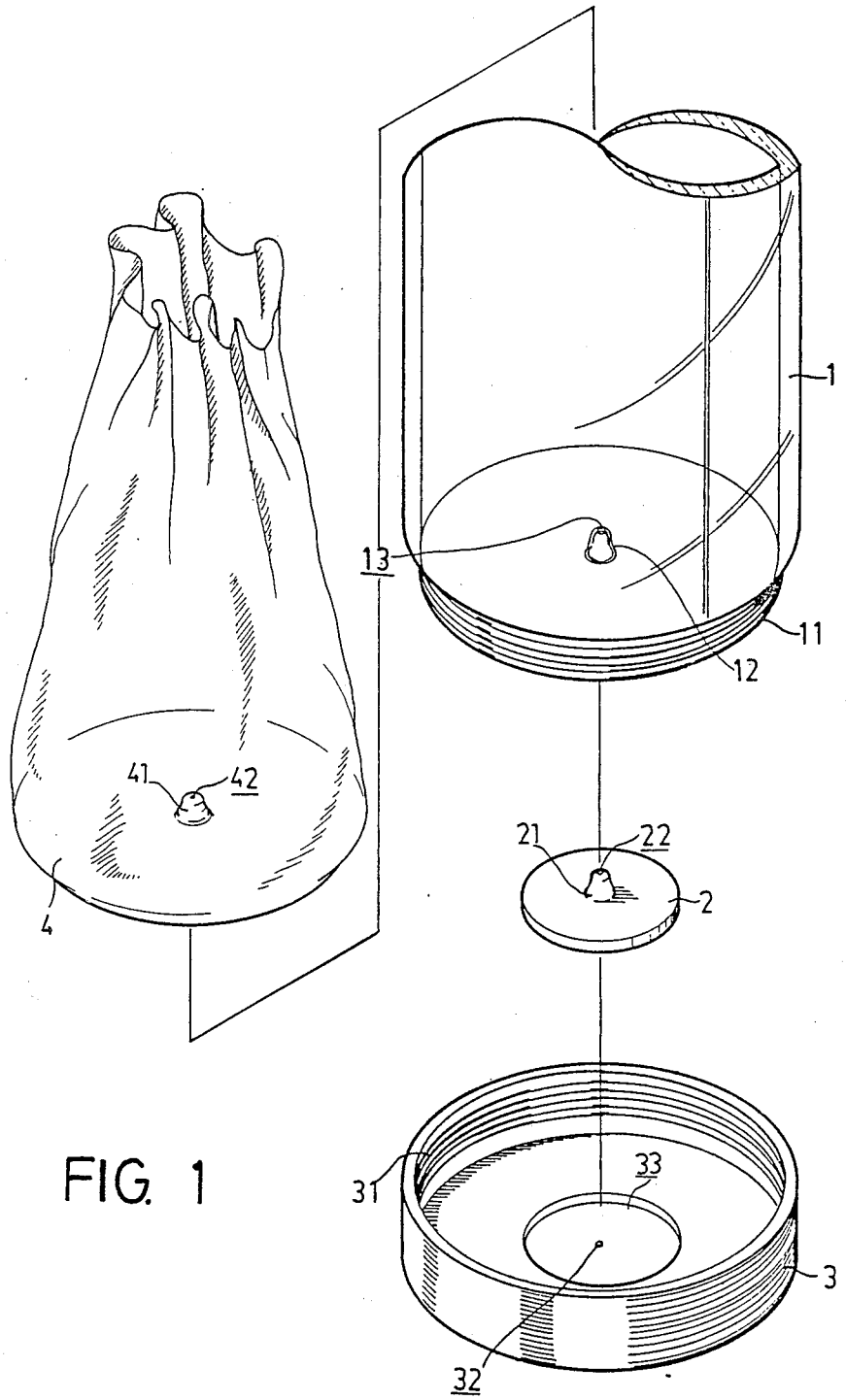
FIG. 1 is a partially cut away, exploded view of a feeding bottle structure incorporated with a disposable liner bag in accordance with this invention.
Figure 2:
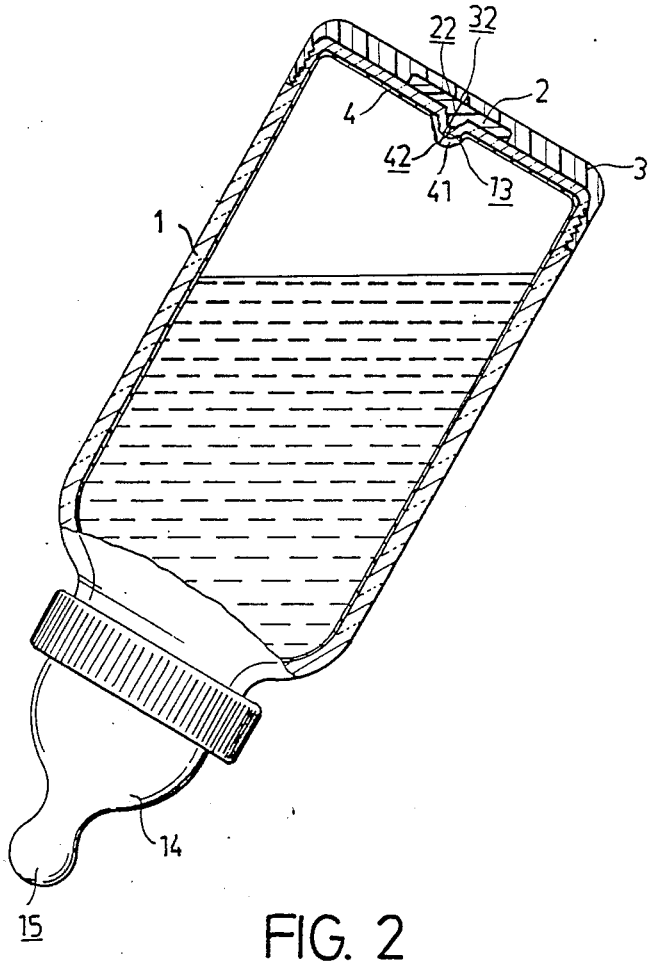
FIG. 2 is a cross-sectional view of the feeding bottle structure of FIG. 1 shown in inverted (non-suction) state.
Figure 3:
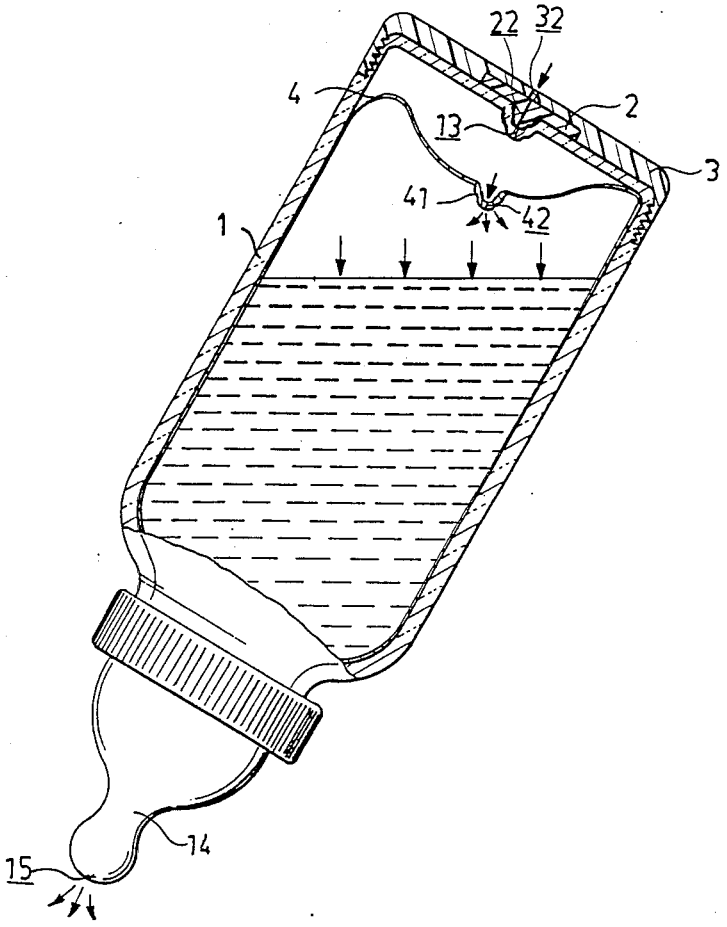
FIG. 3 is a cross-sectional view of the feeding bottle structure of FIG. 1 shown in inverted (suction) state.

With reference to the drawings and particularly to FIG. 1 thereof, it can be seen that a feeding bottle structure according to this invention comprises a bottle 1 provided with male threads 11 on the outer surface at the lower portion thereof and a hollow protrusion 12 extending inwardly from a base of the bottle toward the interior of the bottle 1. Moreover, the top portion of the hollow protrusion 12 is provided with an opening 13. As shown in FIGS. 2 and 3, bottle 1 also includes a nipple 14 provided with an aperture 15 at its end.

A silicon rubber layer 2 is provided with an elastic protrusion 21 in a central location thereon. Furthermore, a vertical slit 22 is formed in a top portion of the elastic protrusion 21, and remains closed during normal (non-suction) conditions.

A cylindrical base casing 3 comprises female threads 31 on the inner surface thereof and a disc-shaped recess 33 disposed at the central portion thereof for receiving the silicon rubber layer 2 therein. Further, a minute vent 32 is positioned at the disc-shaped recess 33 so as to be in axial alignment with the opening 13 and vertical slit 22. Therefore, the whole structure may be combined together by screwing the female threads 31 of base casing 3 onto the male threads 11 of the bottle 1. The overall structure of the feeding bottle is thereby assembled.

A disposable liner bag 4 comprises a reinforced wall 41 made of silicon rubber or the like in a central location thereof. A cut 42 is positioned at the center of the reinforced wall 41. Accordingly, the disposable liner bag 4 matches the structure of the feeding bottle in accordance with this invention. Understandably, the combination of the feeding bottle and disposable liner bag are more convenient and sanitary for outdoor use or for situations in which it is not convenient to clean the feeding bottle.

When the feeding bottle structure is filled with milk or liquids and in non-suction condition, the cut 42 on the disposable liner bag 4 and the slit 22 on elastic protrusion 21 remains tightly closed no matter how the feeding bottle is placed or located. As can be seen in FIG. 2, no milk drips or leaks from the liner bag 4 and the feeding bottle. When the bottle 1 is in inverted (suction) position, the elastic protrusion 21 of the silicon rubber layer 2 is subjected to an atmospheric pressure to open the vertical slit 22 a certain amount to let air flow into the bottle 1 through the vent 32, and the cut 42 on the liner bag 4. This is because of a reduced pressure simultaneously occurring inside the liner bag and the bottle as sucked by a baby. The flowing of air from the slit 22, opening 13 and cut 42 to the liner bag 4, allows a baby to suck on the bottle and drink the milk continuously without any blockage or disturbance.

In conclusion, the feeding bottle structure, whether incorporated with the disposable liner bag 4 or not, in this invention provides an easy-to-suck means for infants which allows air to enter from the base of the bottle 1. As can be seen in FIG. 2, the slit 22 has no direct contact with the milk and therefore neither contamination nor bubbles occur or exist around the slit 22. Moreover, the base casing 3 can be opened or disassembled easily, and the components of the structure can be separately washed. Consequently, milk fat no longer clogs up to the slit 22. Furthermore, the bottom of the present structure has increased weight at the bottom of the feeding bottle, so that the center of gravity is at a lower position than the prior art devices, and therefore does not easily fall down.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claim.

I claim:

1. A nursing bottle comprising:

a bottle having a nipple attached to an upper end thereof, threads formed on an outer surface at a lower portion of said bottle, a hollow protrusion formed on a base of said bottle protruding inwardly toward an interior of the bottle with an opening formed in a top portion of said hollow protrusion;

a silicon rubber layer attached to the exterior of said base having an elastic protrusion formed on a central portion of said rubber layer and received in the hollow protrusion of said bottle, with a vertical slit formed in a top portion of said elastic protrusion;

a cylindrical base casing having threads formed on an inner surface thereof engageable with said threads of said bottle and having a minute vent formed therein; and a disposable liner bag disposed inside said bottle for filling a drinking liquid therein, the improvement which comprises:

(a) said cylindrical base casing having a disc-shaped recess formed in a central portion thereof for receiving said silicon rubber layer therein; and (b) said disposable liner bag including a reinforced wall made of silicon rubber formed on a central portion of said bag bottom, and a cut formed in a central portion of said reinforced wall, said cut of said bag being axially aligned with said opening of said hollow protrusion, said slit of said elastic protrusion of said rubber layer, and said minute vent of said base casing, whereby upon suction on the nipple by a baby, exterior air passes from the exterior of the bottle into the interior of the bag, allowing a smooth drinking of the liquid.

* * * * *